United States Patent [19]

Bounds

[11] Patent Number: 4,921,732

[45] Date of Patent: May 1, 1990

[54] RAILROAD TIE SERVICE VEHICLE AND METHOD FOR SPRAY APPLICATION OF A PRESERVATIVE

[75] Inventor: Ivan E. Bounds, St. Joseph, Mo.

[73] Assignee: Herzog Contracting Corporation, St. Joseph, Mo.

[21] Appl. No.: 200,529

[22] Filed: May 31, 1988

[51] Int. Cl.[5] ..... B05D 3/12

[52] U.S. Cl. ..... 427/325; 118/72; 118/305; 118/306; 118/307; 239/173; 105/72.2; 104/307

[58] Field of Search ..... 427/325, 397; 118/72, 118/305, 306, 307; 105/72.2, 217; 104/9, 16, 307, 279; 239/173, 174, 172, 750; 254/43, 44; 51/178

[56] References Cited

U.S. PATENT DOCUMENTS

| | | | |
|---|---|---|---|
| 1,597,346 | 8/1926 | Fantz et al. | 118/305 X |
| 1,644,486 | 10/1927 | Noel | 118/307 X |
| 2,424,202 | 7/1947 | Woolery | 118/305 |
| 3,144,835 | 8/1964 | Pehoski et al. | 104/307 |
| 3,943,858 | 3/1976 | Dieringer et al. | 104/16 |

*Primary Examiner*—Michael Lusignan
*Assistant Examiner*—Alain Bashore
*Attorney, Agent, or Firm*—Litman, McMahon & Brown

[57] ABSTRACT

A railroad tie service vehicle includes a chassis system, a drive system and an application system. The chassis system includes front and back ends, opposite sides and a deck. The drive system includes an engine mounted on the chassis deck, front and back pairs of wheels and a pair of drive track assemblies mounted on the chassis front and back ends. The application system includes an actuating subassembly for selectively engaging railroad ties and a sprayer subassembly for spraying preservative on railroad ties in response to engagement by the actuating subassembly. A method of servicing railroad ties includes the steps of removing a rail from one side of a railroad track, exposing connection areas where the rail attaches to the railroad ties, driving a vehicle with preservative along the railroad track and applying preservative to the connection areas in response to engagement of the railroad tracks by an actuating subassembly.

41 Claims, 4 Drawing Sheets

RAILROAD TIE SERVICE VEHICLE AND METHOD FOR SPRAY APPLICATION OF A PRESERVATIVE

BACKGROUND OF THE INVENTION

1. Field of the Invention.

The present invention relates generally to the servicing of railroad ties, and in particular to a vehicle for and a method of applying preservative to existing wooden railroad ties in situ.

2. Description of the Prior Art.

Wood has traditionally been, and will probably continue to be, the predominant material for railroad track ties. Wood has several advantages over alternative tie materials, such as concrete. Wood is a renewable natural resource and is available in many parts of the world at reasonable cost. Another important advantage of wood is its natural resiliency, which enables wooden railroad ties to absorb the dynamic loads that are associated with railroad traffic. Wooden railroad ties tend to be lighter in weight than comparable concrete railroad ties, and therefore can be relatively easily handled by installation and maintenance crews and equipment.

A significant disadvantage to wood railroad ties, on the other hand, is that they can be susceptible to decay and deterioration. Since wood is a cellulose material, it is subject to damage from fungus, decay, termite infestation, and exposure to the elements in unprotected, outdoor environments.

Preservatives including coal tar creosote are commonly applied to structural wood members, such as railroad ties, that will be exposed to the elements. However, the protection provided by such preservatives tends to lessen over time because the preservatives are susceptible to the deteriorating effects of sunlight, precipitation, freeze-thaw cycles, etc. Thus, the useful service life of a railroad tie is generally limited by the effectiveness of its preservative treatment.

Railroad ties are particularly susceptible to damage and deterioration in the connection areas adjacent to each end where the tracks are attached. The normal construction of a railroad track involves the placement of ties at intervals of about eighteen to thirty inches in a roadbed of ballast comprising crushed rock or the like. A pair of steel plates are then placed on the connection areas of each tie to support the rails, and spikes are driven through the plates and into the railroad ties, the spike heads securing the rails in place by clamping the lower rail flanges to the plates.

The spikes penetrate interior portions of the ties that may have received little or no preservative. The tie ends are often split by the spikes, exposing other untreated interior portions. Under railroad traffic, these connection areas are naturally subjected to more stress than any other part of the railroad tie, whereby they tend to experience the greatest amount of wear. Moreover, the plates tend to collect and retain moisture, thereby exacerbating deterioration at the connection areas. On most wooden ties the condition of these connection areas tends to deteriorate more rapidly than other portions, yet the connection areas are the most critical for providing rail support and maintaining the integrity of the railroad. Hence, the useful service life of an entire railroad tie is generally limited by the structural integrity of its connection areas.

Several methods have heretofore been employed to correct railroad tie deterioration problems. For example, wood preservative can be injected into the tie connection areas, generally through the holes in the plates that are not occupied by spikes. In normal railroad construction two spikes per plate are used, although the plates typically have at least four holes. Thus, each such plate has two holes available for preservative injection. Although railroad tie life can be prolonged somewhat by this method, a substantial amount of damaged or decayed wood material often remains. The additional preservative may slow the deterioration process, but generally it will not significantly improve the condition of the tie. When enough ties become so deteriorated that a railroad track is deemed unusable, the ties must be replaced at great expense in time and labor.

An intermediate procedure is sometimes employed whereby the tracks are removed, the connection areas are planed down by a resurfacing vehicle, preservative is applied to the exposed wood at the connection areas, and the tracks are remounted. Railroad maintenance equipment is available for removing the spikes, setting the rails aside, scooping out the surrounding ballast and planing the connection areas of the existing ties. Heretofore the preservative has generally been applied manually. However, manual application of the preservative is not particularly desirable because of the inherent difficulties in accurately dispensing predetermined quantities of preservative with manual applicators, the limitations on the amount of preservative that a worker can carry and the hazards to the worker associated with handling the preservative. Creosote-based preservatives are generally toxic and can irritate the skin and eyes of a worker exposed to them. Respirators, face masks and other protective clothing must normally be worn when handling such preservatives.

The present invention addresses these problems associated with preservative application by providing a device and a method for applying the preservative automatically, efficiently and safely.

SUMMARY OF THE INVENTION

In the practice of the present invention, a railroad tie service vehicle is provided which includes a chassis system, a drive system and an application system. The chassis system includes front and back ends, opposite sides and a deck. Containers of preservative may be transported on the chassis deck. The drive system includes an internal combustion engine driving a hydraulic pump. Front and rear pairs of wheels are mounted on the chassis, the rear wheels being driven by a live axle connected to the hydraulic motor. A pair of track subassemblies are mounted on swing arms at the front and back ends of the chassis, and are extendable and retractable between drive and transport positions. The track subassemblies include endless tracks driven by hydraulic motors.

The application system includes a preservative pump communicating with a preservative container, an actuating subassembly adapted to selectively engage railroad ties and a sprayer subassembly adapted to spray preservative in response to engagement by the actuating subassembly with railroad ties.

In the practice of the method of the present invention, the rails along one side of a section of railroad track to be treated are removed. The vehicle wheels on one side of the chassis engage the remaining rails, and on the other side the vehicle is supported and driven by the track subassemblies. As the actuating subassembly engages the railroad ties, a discharge valve opens and preservative is sprayed onto the railroad tie connection areas. When the actuating subassembly disengages railroad ties, the discharge valve is closed.

OBJECTS OF THE INVENTION

The principal objects of the present invention are: to provide a service vehicle for railroad ties; to provide such a vehicle for applying preservative to railroad ties; to provide such a vehicle which automatically dispenses preservative; to provide such a vehicle which minimizes preservative waste; to provide such a vehicle which uniformly applies preservative to railroad ties; to provide such a vehicle which substantially separates an operator from the preservative; to provide such a vehicle which is relatively safe for an operator to use; and to provide such a vehicle which is efficient in operation, capable of a long operating life, economical to manufacture and particularly well adapted for the proposed usage thereof. Further objects of the present invention include: to provide a method of servicing railroad ties in situ; to provide such a method wherein preservative is applied to the railroad ties automatically; to provide such a method which is relatively safe and efficient; and to provide such a method which is particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Environment and Introduction

Figure 1:
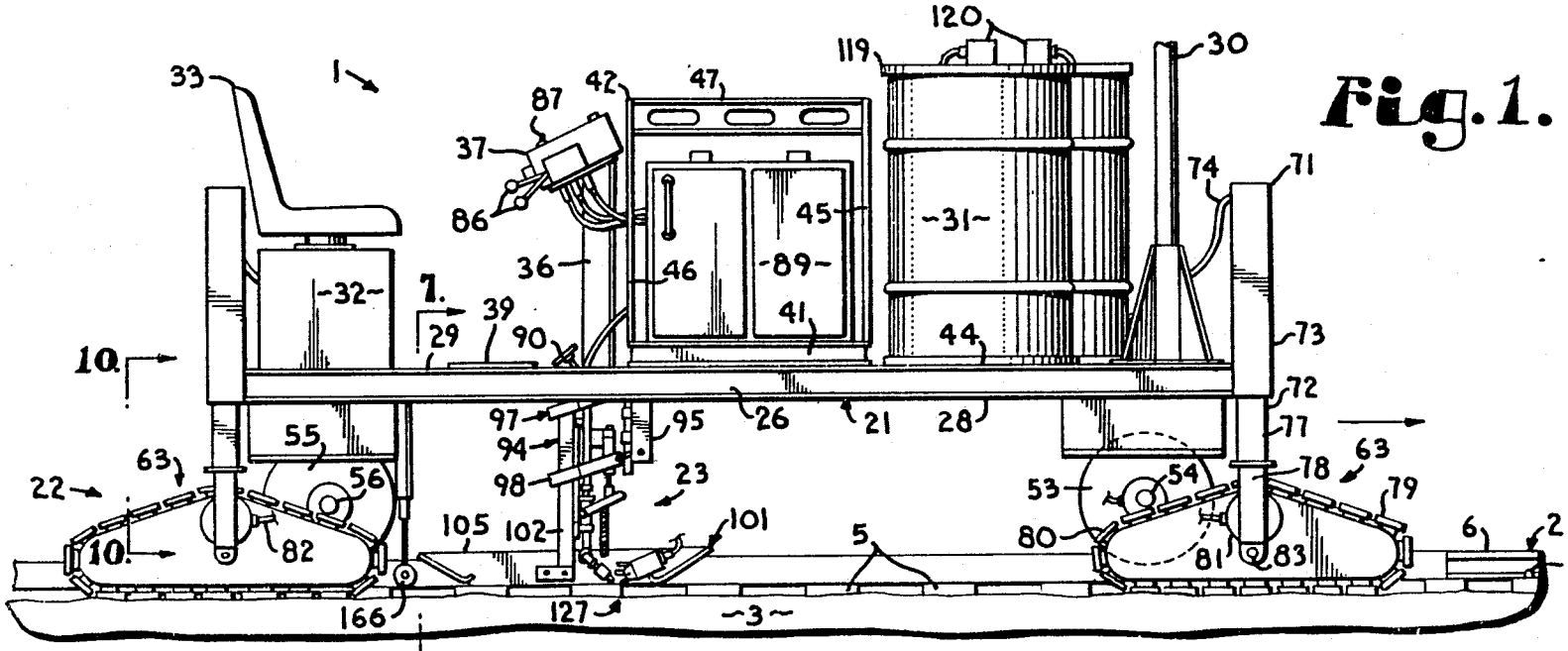
FIG. 1 is a side elevational view of a vehicle for applying preservative to railroad ties, embodying the present invention.
Figure 2:
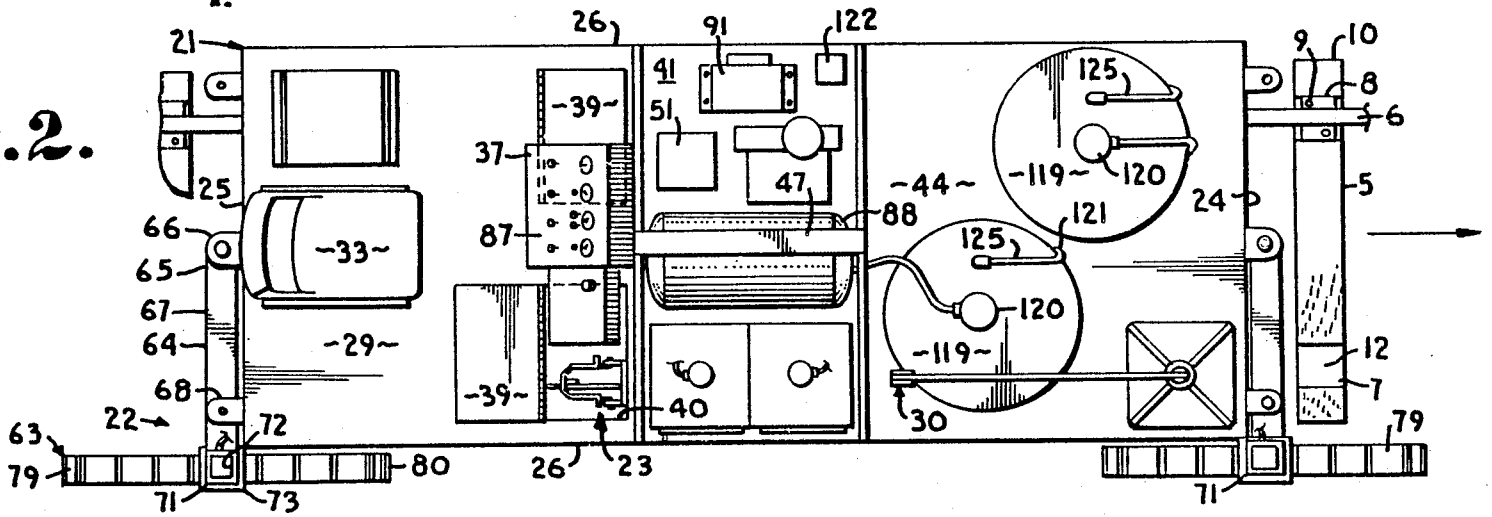
FIG. 2 is a top plan view of the vehicle.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates a self-propelled preservative application vehicle embodying the present invention. Without limitation on the generality of useful applications for the vehicle 1, it is shown and described in an exemplary operation for repairing a railroad line 2 including a ballast roadbed 3, railroad ties 5 and rails 6 including connection areas 7 upon which steel plates 8 are placed for supporting the rails 6. The rails 6 and the plates 8 are secured to the ties 5 by spikes 9 in the normal manner. The tie connection areas 7 provide primary support for the railroad traffic loads through the rails 6 and the plates 8. Each connection area 7 is located adjacent to a respective railroad tie end 10. Before treatment with the preservative application vehicle 1, the connection areas 7 are preferably planed down with a vehicle (not shown) that is commercially available and commonly used for this purpose by the railroads.

After being planed down, shallow notches 11 are formed in the railroad ties 5 at the connection areas 7 whereat relatively sound, untreated wood is exposed. By planing the railroad ties 5 in the connection areas 7, an external layer of decayed wood is preferably removed, exposing a connection area surface 12 of relatively sound, raw wood that previously has received little or no preservative since most of the original preservative is concentrated at or near the exterior surfaces of the railroad ties 5. Without limitation on the generality of materials that may be applied with the vehicle 1, the preservative may comprise creosote-based preservative available under the trademark "ADZ-LIFE" from Osmose Wood Preserving, Inc. of Buffalo, New York.

The vehicle 1 generally comprises a chassis system 21, a drive system 22 and a preservative application system 23, which will be described below in detail.

II. Chassis System

The chassis system 21 includes a front 24, a back 25 and opposite sides 26. A framework 28 is fabricated from structural steel members and mounts a deck 29. Adjacent to the chassis front 24, a boom assembly 30 is provided for loading and unloading containers 31, e.g., fifty-five gallon drums, of preservative. Adjacent to the chassis back end 25 a storage locker 32 is provided and mounts an operator's seat 33. In front of the operator's seat 33 a pedestal 36 mounts a control panel 37. On both sides of the pedestal 36, the deck 29 includes application system access openings 40 selectively covered by hinged, sprayer access panels 39.

An engine base 41 is mounted on the deck 29 in front of the pedestal 36 and a preservative container area 44 is located in front of the engine base 41 and adjacent to the boom assembly 30. A superstructure frame 42 is mounted on the engine base 41 and includes front and back A-frame sections 45, 46 innerconnected at their tops by a longitudinally-extending superstructure beam 47.

III. Drive System

Figure 10:
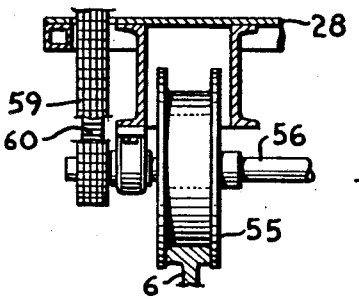
FIG. 10 is an enlarged, fragmentary, vertical cross-sectional view of the vehicle taken generally along line 10—10 in FIG. 1 and particularly showing a drive arrangement for a live rear axle with a rear wheel engaged on a rail.
Figure 11:
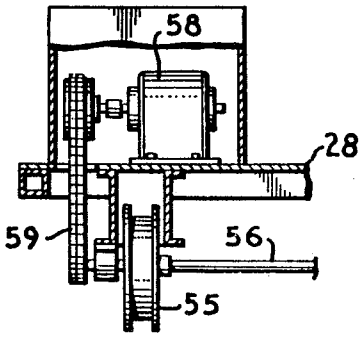
FIG. 11 is an enlarged, fragmentary, vertical cross-sectional view of the vehicle, particularly showing a hydraulic drive motor for the rear axle.

The drive system 22 includes a prime mover comprising, for example, an internal combustion engine 48 mounted on the engine base 41. A twenty-two horsepower diesel engine has been found to be sufficient to drive the vehicle 1 and to operate its application system 23. The engine 48 drives a hydraulic pump 51. A pair of freely rotatable front wheels 53 are mounted on a front axle 54 in proximity to the chassis system front end 24. It is not necessary that the front wheels 53 be driven. A pair of rear wheels 55 are mounted on the chassis system 21 in proximity to its back end 25 and are drivingly innerconnected by a live rear axle 56. A hydraulic drive motor 58 is mounted on top of the deck 29 in proximity to the chassis back end 25 and is drivingly innerconnected to the rear wheels 55 and the axle 56 by a chain 59 engaging a sprocket 60 coupled to the live rear axle 56 (FIGS. 10 and 11).

A pair of retractable drive track assemblies 63 are mounted on the chassis front and back ends 24, 25 and each includes a swing arm 64 with a proximate end 65 journaled in a respective pivot clevis 66 mounted on a respective chassis front or back end 24, 25 and a distal end 67. The swing arm distal ends 67 are each captured in one of the locking clevises 68 which are mounted in pairs on the chassis front and back ends 24, 25 in proximity to the chassis sides 26.

A pair of telescoping track jack subassemblies 71 are mounted on the swing arm distal ends 67 and each includes inner and outer telescopic tubes 72, 73 reciprocable with respect to each other by a hydraulic piston-and-cylinder unit 75 within the track jack subassembly 71. The track jack subassemblies 71 communicate with the hydraulic pump 51 via suitable hydraulic fluid lines 74. Although hydraulically-actuated track jack subassemblies 71 are disclosed, it will be appreciated that other actuating means may be provided, for example a pneumatic piston-and-cylinder unit or a screw-threaded rod with a motor drive.

The inner telescopic tubes 72 terminate at lower ends 77 mounting track clevises 78, which in turn mount track subassemblies 79. Each track subassembly 79 includes an endless track 80 driven by a hydraulic motor 81 communicating with the hydraulic pump 51 by suitable hydraulic fluid lines 82. The track subassemblies 79 are pivotally mounted on the track clevises 78 by pivot pins 83 aligned on transverse pivotal axes whereby the track subassemblies 79 can rock fore and aft in response to conditions that are encountered along the path of travel. The control panel 37 mounts a set of lever controls 86 for controlling the flow of pressurized hydraulic fluid to the track jack subassemblies 71, the hydraulic drive motor 58 and the drive track hydraulic motors 81. The control panel 37 also includes suitable controls 87 for the engine 48. A two compartment diesel fuel and hydraulic fluid tank 89 is mounted on the engine base 41 adjacent one side 26 of the chassis system 21 and supplies the engine 48 with diesel fuel and the hydraulic pump 51 with hydraulic fluid.

A foot pedal 90 is provided on the deck 29 behind the pedestal 36 and is connected to a hydraulic clutch valve (not shown), which in turn is connected to the hydraulic drive motor 58. When the foot pedal 90 is depressed, the hydraulic clutch valve is open and fluid is allowed to circulate through the hydraulic drive motor 58. When the vehicle 1 is being driven by the track subassembly 79, the hydraulic clutch valve is preferably open so that the rear wheels 55 are thus permitted to rotate freely. Preferably the foot pedal 90 is provided with a latch (not shown) for holding it in its down position with the hydraulic clutch valve open so that an operator of the vehicle 1 does not have to hold the foot pedal 90 down continuously when the vehicle 1 is being driven by the track subassemblies 79.

When the foot pedal 90 is released and raised, the hydraulic clutch valve closes, whereby hydraulic fluid is prevented from circulating freely through the hydraulic drive motor 58. Closing the hydraulic clutch valve has the effect of blocking or restricting the flow of hydraulic fluid through the hydraulic drive motor 58. When the live rear axle 56 is rotated by movement of the vehicle 1, its connection to the hydraulic drive motor 58 causes the latter to rotate and pump hydraulic fluid through the hydraulic drive system. Therefore, a braking action is applied to the live rear axle 56 when the foot pedal 90 is released and raised and the hydraulic clutch valve blocks or restricts hydraulic fluid flow since the closed hydraulic system will resist rotation of the hydraulic drive motor 58 and the live rear axle 56.

A caliper and disc brake system (not shown) is also provided on the axles 54, 56 and may be applied by an operator of the vehicle 1.

IV. Application System

The application system 23 includes an air compressor 91 which is driven by the diesel engine 48 and is mounted on the engine base 41. The application system 23 is adapted for placement in one of the side access openings 40 whereby it is suspended below the chassis system 21 and above the railroad ties 5. A mounting subassembly 94 includes a channel member 95 secured to and depending downwardly from the chassis framework 28 at the front of a respective access opening 40. The channel member 95 pivotably mounts upper and lower U-shaped brackets 97, 98. Each U-shaped bracket 97, 98 includes a pair of outwardly-extending end flanges 92 fixedly mounting respective L-shaped bolts 93 which are pivotally received in respective side flanges 96 of the channel member 95.

The U-shaped brackets 97, 98 mount a skid runner subassembly 101 including a vertical standard 102 pivotably connected to the brackets 97, 98 and terminating at a lower end 103. Each bracket 97, 98 also includes a center section 99 fixedly mounting a forwardly-extending U-shaped bolt which is pivotably received in the skid runner subassembly standard 102. A freely translatable, parallelogram linkage arrangement is thus formed by the channel member 95 and the standard 102, which remain parallel with respect to each other, and with the parallel upper and lower brackets 97, 98. These components define a parallelogram and are pivotally connected at their respective intersections by the bolts 93, 100.

Figure 4:
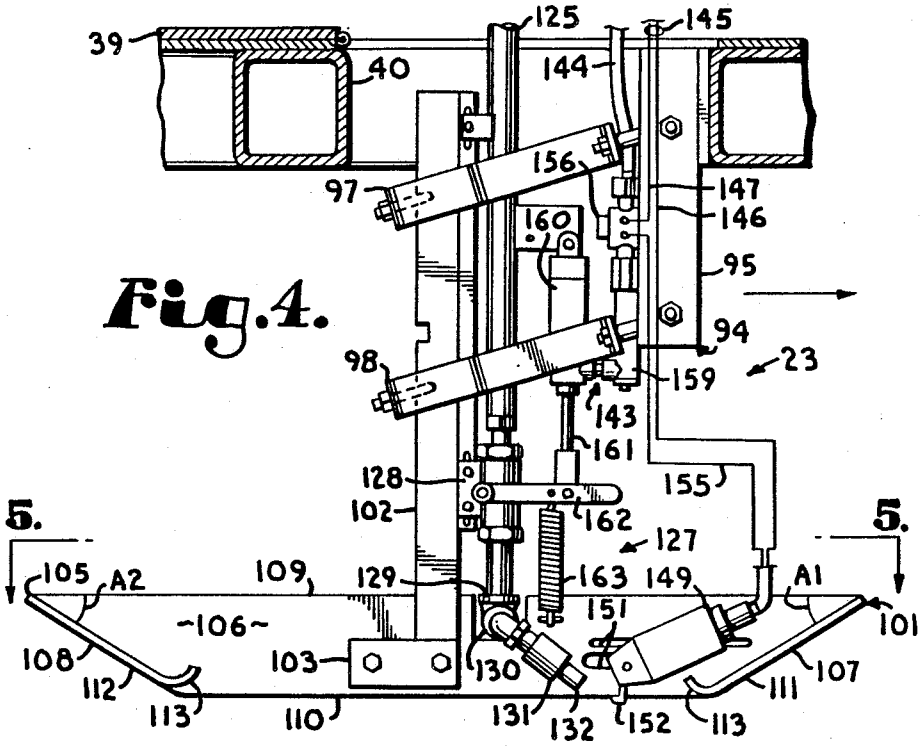
FIG. 4 is a fragmentary, side elevational view of the vehicle, particularly showing an application system.
Figure 3:
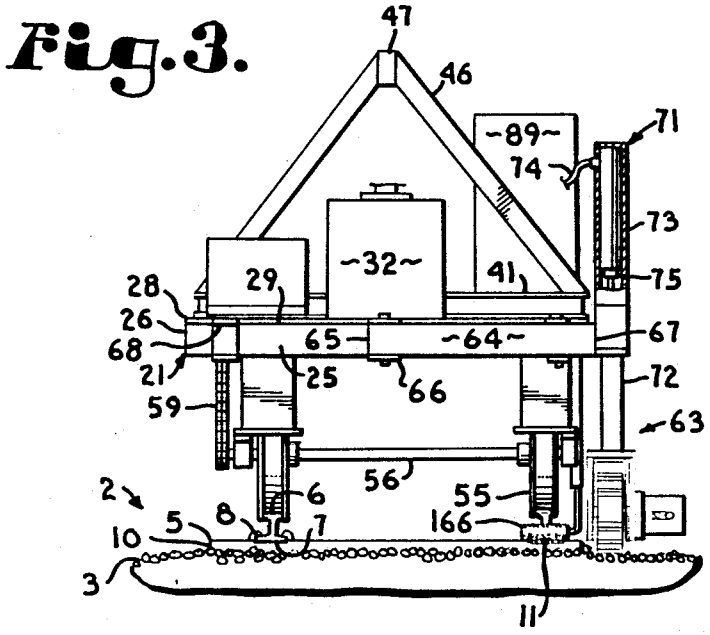
FIG. 3 is a rear elevational view of the vehicle.
Figure 6:
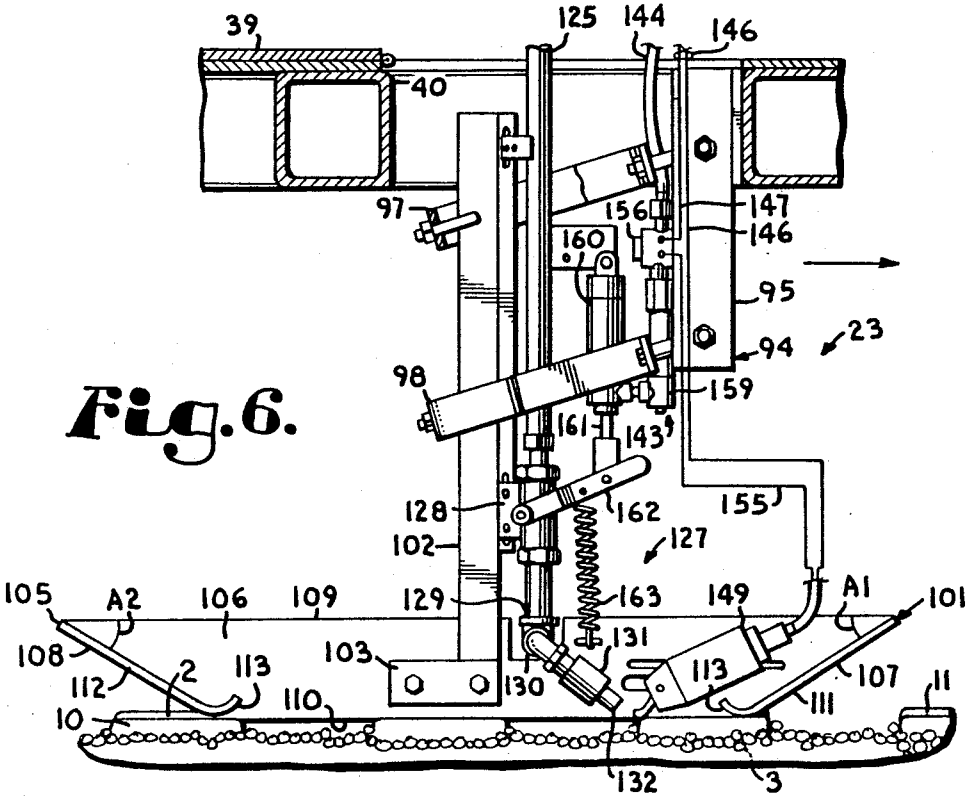
FIG. 6 is an enlarged, side elevational view of the application system, with a preservative valve in its open position.
Figure 8:
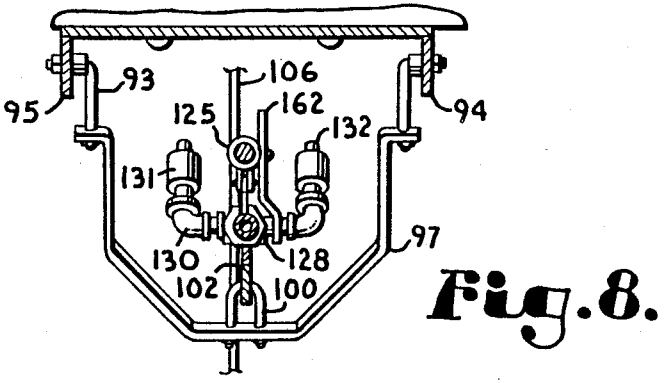
FIG. 8 is an enlarged, fragmentary, horizontal cross-sectional view of the vehicle taken generally along line 8—8 in FIG. 7 and particularly showing the application system.
Figure 13:
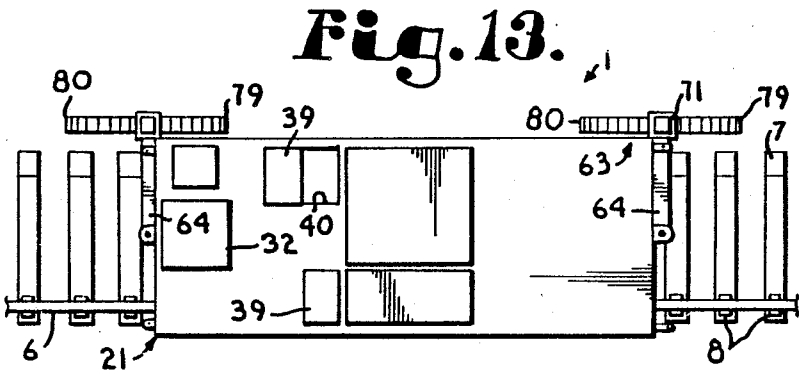
FIG. 13 is a top plan view of the vehicle in operation on a section of railroad track with the left-hand rail removed.
Figure 12:
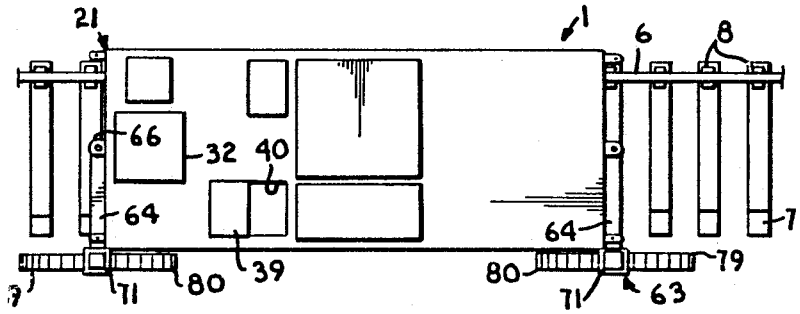
FIG. 12 is a top plan view of the vehicle in operation on a section of railroad track with the right-hand rail removed.

The standard lower end 103 fixedly mounts a skid runner 105 having a body 106 and front and back ends 107, 108 whereat the body 106 is undercut with its front and back ends 107, 108 forming acute angles A1, A2 respectively with respect to the horizontal. The skid body 106 also includes upper and lower edges 109, 110. Front and rear skid ramp plates 111, 112 are mounted on the body front and back ends 107, 108 respectively and slope in respective directions upwardly and away from the center of the body 106. The skid ramp plates 111, 112 have upturned inner (lower) ends 113 to prevent the skid runner 105 from catching a railroad tie 5 and damaging the skid subassembly 101. The inner (lower) end 113 of the front skid ramp plate 111 is mounted flush with the skid body lower edge 110. The inner (lower) end 113 of the rear ramp plate 112 is spaced slightly (e.g., about one-fourth inch) above the skid body lower edge 110 (FIGS. 4 and 6).

A drumhead subassembly 119 is mounted on a respective preservative drum 31 and includes a pneumatic motor 120 driving a stirring device (not shown) for stirring the preservative contents of the container 31. The pneumatic motor 120 is connected to an air compressor 91 which communicates with an air tank 88. The drumhead assembly 119 also includes a preservative suction line 121 connected to a preservative pump 122 powered by the air compressor 91. A preservative supply line 125 extends from the pump 122 to a sprayer subassembly 127 mounted on the skid subassembly standard 102.

The sprayer subassembly 127 includes a discharge valve 128 connected to a T-fitting 129, which forms a manifold 130 connected to a pair of spray heads 131 each having a discharge nozzle 132. An actuating subassembly 143 is mounted on the supply line 125 and includes a pneumatic line 124 communicating with the air compressor 91 and an electrical line 145 including first and second leads 146, 147 (comprising, e.g., positive and negative) connected to an electrical power source (not shown).

Figure 9:
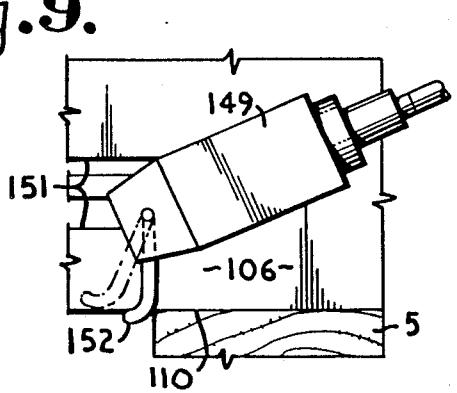
FIG. 9 is an enlarged, fragmentary, side elevational view of the application system particularly showing an actuating switch thereof.
Figure 5:
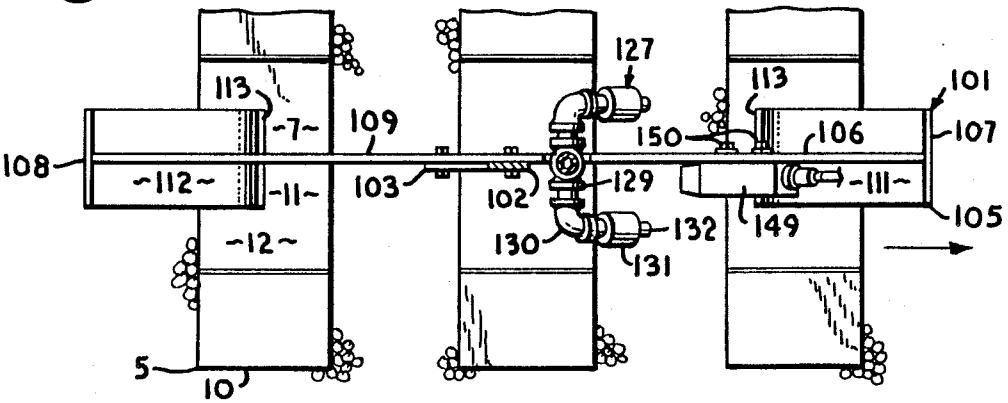
FIG. 5 is an enlarged, horizontal, cross-sectional view of the vehicle, taken generally along line 5—5 in FIG. 4.
Figure 7:
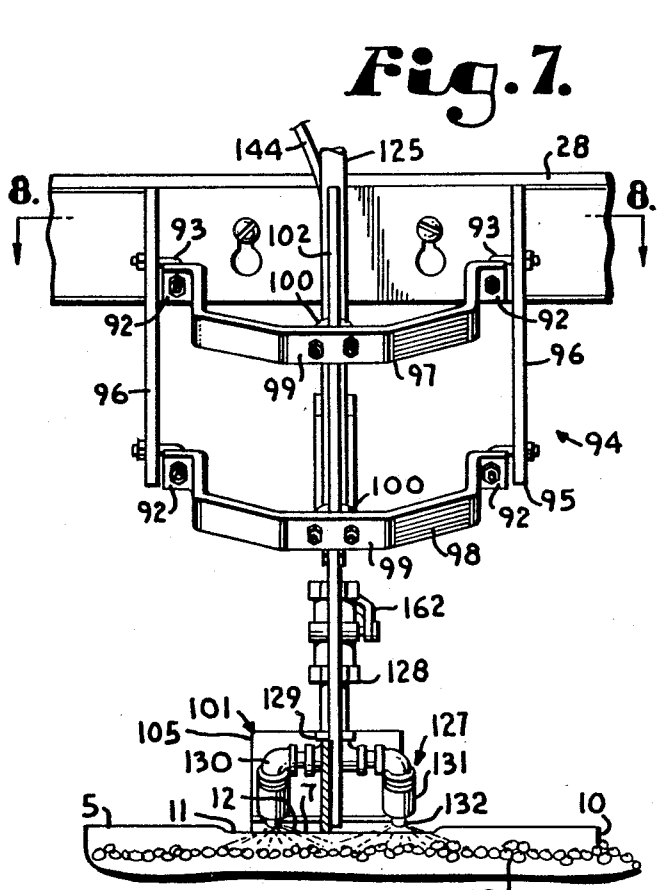
FIG. 7 is an enlarged, fragmentary, vertical cross-sectional view of the vehicle taken generally along line 7—7 in FIG. 1.

The first electrical lead 146 communicates with a single pole, normally open, momentary contact actuating switch 149 mounted on the skid body 106 by bolts 150. The switch mounting bolts 150 are received in slots 151 in the skid body 106 so that the position and orientation of the switch 149 can be adjusted. The switch 149 includes a trigger 152 movable between a first position shown in solid lines in FIG. 9 whereat the switch 149 is open and a second position shown in phantom lines in FIG. 9 whereat the switch is closed. A jumper lead 155 and the second lead 147 are attached to a normally-closed, solenoid-actuated pneumatic valve 156. When the switch 149 closes, current flows from the first lead 146, through the switch 149 and through the jumper lead 155 whereby the pneumatic valve 156 opens. When the pneumatic valve 156 opens, pressurized air from the pneumatic line 144 passes through the pneumatic valve 156, through a coupling 159 and into one end of a pneumatic piston-and-cylinder unit 160 with a reciprocating piston rod 161. The piston rod 161 is coupled to an actuating lever 162 on the sprayer subassembly valve 128. The actuating lever 162 is connected to the skid body 106 by a return spring 163.

A preservative roller 166, which may comprise a paint roller, is suspended from the chassis system 21 behind the skid subassembly 101.

V. OPERATION

Figure 15:
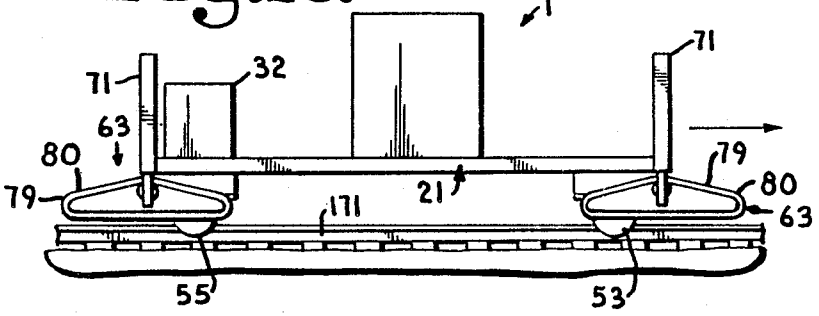
FIG. 15 is a side elevational view of the vehicle in the street crossing.
Figure 16:
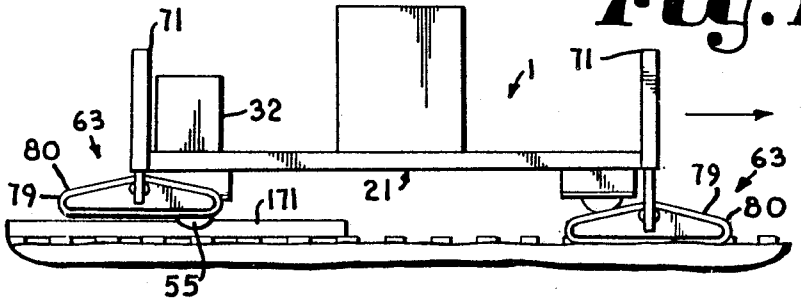
FIG. 16 is a side elevational view of the vehicle as it leaves the street crossing.

A section of railroad track 2 to be treated with the vehicle 1 according to the method of the present invention is taken out of service and the rails 6 along one side are removed and set aside. However, as will be explained more fully hereinafter, neither of the rails 6 at a street crossing 171 (FIGS. 14–16) are removed. A respective front wheel 53 and a respective back wheel 55 at the other chassis side 26 engage the remaining rail 6 and the track jack subassemblies 71 lower the drive track assemblies 63 to their extended driving positions whereby the wheels 53, 55 on the one side 26 are raised above the roadbed 3. The vehicle 1 is thus supported on a pair of wheels 53, 55 on one side and on the drive track assemblies 63 on the other side where the rail 6 has been removed. The drive track assemblies 63 are syncronized in operation and the vehicle 1 may be driven entirely by them.

As shown in FIG. 6, the skid lower edge 110 has a length between the ramp plate ends 113 approximately equal to the center-to-center spacing between the railroad ties 5. The skid runner 105 is thus designed to rest substantially continuously on the notched connection areas 7 of the railroad ties 5. Preferably the notched connection areas 7 are relatively level, whereby the skid runner 105 will travel on a substantially level path.

The roadbed 3 on which the drive track assemblies 63 ride, however, is often not level so that the vehicle 1 may tilt slightly from one side to the other in motion. The application system 23, however, is designed to compensate for such tilting and to maintain the sprayer subassembly 127 in substantially continuous contact with the railroad ties 5. This is accomplished by the pivotal, parallelogram linkage between the channel member 95, the brackets 97, 98 and the skid standard 102. Since the entire sprayer and actuating subassemblies 127, 143 are mounted on the skid standard 102, they likewise "float" with the skid subassembly 101 to compensate for the slight tilting of the vehicle 1. The purpose of this arrangement is to maintain the skid runner 105 in substantially continuous contact with the railroad tie connection areas 7. The operator of the vehicle 1 can level it with the track jack subassemblies 71. Alternatively, an automatic leveling mechanism can be provided.

The front skid ramp plate 111 is normally the first part of the vehicle 1 to engage a railroad tie 5, and its inner (lower) end 113 is mounted flush with the skid body lower edge 110 so that the weight of the application system 23 may be distributed across the width of the front skid ramp plate 111 where it slidably contacts a respective railroad tie connection area 7. Upon engaging a railroad tie 5, the switch trigger 152 will swing from its open position shown in solid lines in FIG. 9 to its closed position shown in phantom lines in FIG. 9 whereby the switch 149 will close and electrical current will flow through the first lead 146, through the switch 149, through the jumper lead 155 and to the pneumatic, solenoid-actuated valve 156. The valve 156 will thus open, pressurized air will flow through the pneumatic line 144, through the pneumatic valve 156, through the coupling 159 and into the pneumatic piston assembly unit 160 whereby the piston rod 161 will be retracted and will lift the actuating lever 162, opening the sprayer valve 128. Preservative will thus flow through the supply line 125, the valve 128, the T-fitting 129, the manifold 130, the spray heads 131 and be sprayed from the nozzles 132 on either side of the skid runner 105.

The nozzles 132 are oriented forwardly and downwardly whereby most of the preservative sprayed therefrom is placed on the railroad tie connection area 7. By properly adjusting the actuating subassembly 143, relatively little of the preservative will be wasted on the roadbed 3, and maximum preservation and benefit will be obtained.

The inner (lower) end 113 of the rear skid ramp plate 112 is spaced above the skid body lower edge 110 so that preferably only the skid body lower edge 110 contacts the railroad tie connection area 7 which has just been coated with the preservative. By spacing the inner (lower) end 113 of the rear skid ramp plate 112 above the railroad tie connection area 7, in normal operation most of the preservative will remain on the railroad tie connection area 7 and will not be pushed off by the inner (lower) end 113 of the rear skid ramp plate 112 as it passes over the railroad tie connection area 7. The preservative roller 166 then rolls over the connection area 7 to which preservative has just been applied to distribute the preservative thereover.

Figure 14:
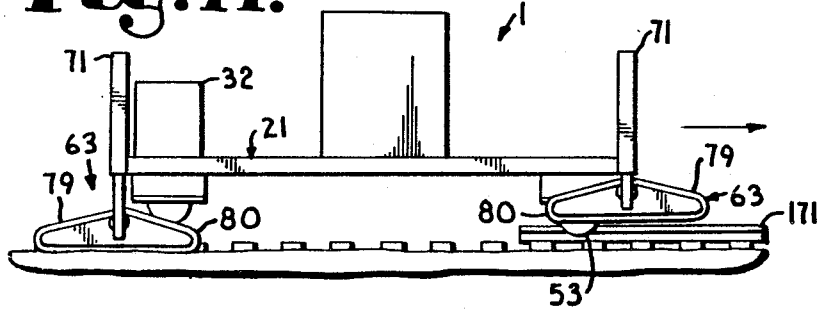
FIG. 14 is a side elevational view of the vehicle as it enters a street crossing.

In the method of the present invention, both rails 6 are left in place at a street crossing 171. As the vehicle approaches the street crossing 171, the front drive track assembly 63 is raised to a retracted travel position with a respective track jack subassembly 71 whereby both front wheels 53 engage the rails 6 (FIG. 14).

The rear drive track assembly 63 is then raised (FIG. 15) whereby all four wheels 53, 55 are on the rails 6. In this configuration the vehicle 1 is driven by the hydraulic drive motor 58 which is coupled to the live rear axle 56. When the vehicle 1 leaves the street crossing 171 (FIG. 16), the procedure is reversed whereby first the front drive track assembly 63 is lowered and then the rear drive track assembly 63 is lowered to resume normal operation.

When converting the vehicle 1 for operation on the other side, the drive track assemblies 63 are raised whereby the vehicle 1 is supported on all four wheels 53, 55. The swing arms 64 are then released from the locking clevises 68, swung to the other side and locked into respective locking clevises 68 adjacent the other chassis side 26. The application system 23 is then removed from one of the access openings 40 and placed in the access opening 40 adjacent the other chassis side 26 by lifting the other access panel 39. The vehicle 1 can then be driven onto a track section where one of the rails 6 has been removed, whereat the drive track assemblies 63 would be lowered to resume normal operation.

It is to be understood that while certain forms of the present invention have been illustrated and described herein, it is not to be limited to the specific forms or arrangement of parts described and shown.

What is claimed and desired to be secured by Letters Patent is as follows:

1. A vehicle for applying preservative to the railroad ties of a railroad track including a rail, which comprises:

(a) a chassis system adapted to receive a container of the preservative;

(b) a drive system mounted on said chassis system and adapted to drive said vehicle along the railroad track; and (c) an application system associated with said chassis system and including:

(1) dispenser means adapted to dispense said preservative onto the railroad ties; and (2) automatic actuating means including position sensing means adapted to sense a first position of said vehicle with respect to a railroad tie whereat said dispenser means is directed towards said railroad tie and a second position with said dispenser means directed between a pair of railroad ties, said actuating means being adapted to automatically actuate said dispenser means with said vehicle in its first position and further being adapted to automatically deactuate said dispenser means with said vehicle in its second position.

2. The vehicle according to claim 1 wherein said drive system includes:

(a) a drive track assembly mounted on said chassis.

3. The vehicle according to claim 2 wherein:

(a) said drive track assembly is vertically movable between an extended drive position and a retracted travel position.

4. The vehicle according to claim 3 wherein said drive track assembly includes:

(a) a track jack subassembly including inner and outer telescoping tubes and jack means for extending and retracting said drive track assembly.

5. The vehicle according to claim 3 wherein said drive system includes:

(a) an axle mounted on said chassis;

(b) a pair of wheels mounted on said axle, each said wheel being adapted to engage a respective railroad track rail; and (c) motor means drivingly connected to said axle.

6. The vehicle according to claim 5 wherein:

(a) said drive track assembly is adapted to drive said vehicle in its extended drive position; and (b) one of said wheels being adapted to drive said vehicle when said drive track assembly is in its retracted travel position.

7. The vehicle according to claim 1 wherein said drive system includes:

(a) an engine mounted on said chassis system; and (b) hydraulic drive means connected to said engine.

8. The vehicle according to claim 1 wherein said dispenser means includes a sprayer subassembly mounted on said chassis and adapted for positioning in proximity to the railroad tracks.

9. The vehicle according to claim 8 wherein said application system includes pump means adapted for communicating with a preservative container and communicating with the sprayer subassembly.

10. The vehicle according to claim 9 wherein said application system includes:

(a) a material supply line communicating said pump means with said sprayer subassembly;

(b) a material valve in said material supply line; and (c) said actuating means being adapted to selectively open and close said material valve.

11. The vehicle according to claim 10 wherein said actuating means includes:

(a) an air compressor;

(b) a piston-and-cylinder unit connected to and adapted to open and close said preservative valve;

(c) a pneumatic supply line connected to said air compressor and to said piston-and-cylinder unit; and (d) a pneumatic valve in said pneumatic supply line.

12. The vehicle according to claim 11 wherein said actuating means includes:

(a) an electrical power source;

(b) a solenoid connected to and adapted for actuating said pneumatic valve; and (c) switch means adapted for selectively innerconnecting said electrical power source and said solenoid.

13. The vehicle according to claim 12 wherein:

(a) said switch means comprises a momentary contact switch mounted on said chassis and adapted to selectively contact the railroad ties, said switch being closed when in contact with a railroad tie and open when disengaged therefrom.

14. The vehicle according to claim 1 wherein:

(a) said application system includes a skid runner subassembly depending from said chassis system and mounting said dispenser means.

15. The vehicle according to claim 14 wherein:

(a) said skid runner subassembly includes a skid runner with front and back beveled ends.

16. The vehicle according to claim 15 wherein said application system includes:

(a) a mounting subassembly mounting said skid runner subassembly on said chassis, said mounting subassembly including a parallelogram linkage adapted to vertically, movably mount said skid runner subassembly on said chassis.

17. A vehicle for applying preservative to the railroad ties of a railroad track having at least one rail, which comprises:

(a) a chassis system including:

(1) front and back ends;

(2) opposite sides;

(3) a framework; and (4) a deck mounted on said framework;

(b) a drive system including:

(1) a prime mover;

(2) front and back drive track assemblies each mounted on a respective chassis system end and including a track subassembly with an endless track drivingly connected to said prime mover; and (c) an application system including:

(1) a preservative container on said chassis deck;

(2) a preservative pump communicating with said container;

(3) a sprayer subassembly;

(4) a runner subassembly mounted on said chassis and mounting said sprayer subassembly;

(5) a preservative valve having an open position communicating material from said pump to said sprayer subassembly and a closed position; and (6) an actuating subassembly adapted to selectively open and close said material valve.

18. The vehicle according to claim 17 wherein:

(a) said drive track assemblies are vertically movable between extended driving positions and retracted travel positions.

19. The vehicle according to claim 18 wherein each said drive track assembly includes:

(a) a track jack subassembly including inner and outer telescoping tubes and jack means for extending and retracting said drive track assembly.

20. The vehicle according to claim 19, which includes:

(a) a hydraulic pump drivingly connected to said prime mover; and (b) each said jack means comprising a hydraulic piston-and-cylinder unit connected to said hydraulic pump.

21. The vehicle according to claim 17 wherein each said drive track assembly includes:

(a) a swing arm with a proximate end pivotally mounted on one of said vehicle front and back ends and a distal end;

(b) a track subassembly mounted on said swing arm distal end; and (c) said drive track assembly being swingable on said swing arm between a first position on one of said vehicle opposite sides and a second position on the other said vehicle side.

22. The vehicle according to claim 17 wherein said drive system includes:

(a) a hydraulic pump;

(b) a hydraulic motor connected to said hydraulic pump;

(c) a live axle mounted transversely on said chassis and drivingly connected to said hydraulic motor; and (d) a pair of wheels mounted on said axle, each said wheel being adapted to engage a respective railroad track rail.

23. The vehicle according to claim 21 wherein said drive system includes:

(a) a hydraulic pump; and (b) each said track subassembly including a hydraulic motor connected to said hydraulic pump and an endless track drivingly connected to said hydraulic motor.

24. The vehicle according to claim 17 wherein:

(a) said actuating subassembly includes:

(1) an air compressor;

(2) a pneumatic piston-and-cylinder unit connected to and adapted to open and close said material valve;

(3) a pneumatic supply line connected to said air compressor and said piston-and-cylinder unit; and (4) a pneumatic valve in said pneumatic supply line.

25. The vehicle according to claim 24 wherein said actuating subassembly includes:

(a) an electrical power source;

(b) a solenoid actuating said pneumatic valve; and (c) switch means adapted for selectively innerconnecting said electrical power source and said solenoid.

26. The vehicle according to claim 25 wherein:

(a) said switch means comprises a momentary contact switch mounted on said runner subassembly and adapted to selectively contact the railroad ties, said switch being closed when in contact with a railroad tie and open when disengaged therefrom.

27. The vehicle according to claim 17 wherein:

(a) said runner subassembly includes a skid runner with front and back beveled ends adapted to selectively, slidingly engage the railroad ties.

28. The vehicle according to claim 17 wherein said application system includes:

(a) a mounting subassembly mounting said runner subassembly on said chassis, said mounting subassembly including a parallelogram linkage adapted to vertically, movably mount said runner subassembly on said chassis.

29. The vehicle according to claim 17 wherein said sprayer subassembly includes:

(a) a pair of spray nozzles each positioned on a respective side of said runner subassembly and adapted to be aimed downwardly at the railroad ties.

30. A vehicle for applying preservative to the railroad ties of a railroad track having at least one rail, which comprises:

(a) a chassis system including:
(1) front and back ends;
(2) opposite sides;
(3) a framework;
(4) a deck mounted on said framework;
(5) an area on said deck adapted to receive a container of the preservative;
(6) a boom assembly adapted to load a preservative container onto said deck;
(7) an operator's station;
(8) an engine base;
(9) a pair of access openings in said deck each postioned in proximity to a respective side of said chassis system; and
(10) a pair of access panels each hingedly mounted on said deck and adapted to selectively cover a respective access opening;

(b) a drive system including:
(1) an internal combustion engine;
(2) a hydraulic pump drivingly connected to said engine;
(3) a front, freely-rotatable axle associated with said chassis system front end and mounting a pair of front wheels;
(4) a live, rear axle associated with said chassis system back end and mounting a pair of rear wheels;
(5) a hydraulic drive motor communicating with said hydraulic pump and drivingly connected to said rear axle;
(6) a hydraulic drive system connecting said hydraulic pump and said hydraulic drive motor, said hydraulic drive system including a clutch valve with an open position permitting the flow of hydraulic fluid through said hydraulic motor and a closed position whereat the flow of hydraulic fluid through said hydraulic motor is restricted;
(7) front and back drive track assemblies each mounted on a respective chassis system end, each said drive track assembly including a swing arm with a proximate end pivotally connected to said chassis system end and a distal end;
(8) a pair of track jack subassemblies each mounted on a respective swing arm distal end, said track jack subassemblies being vertically, hydraulically movable between raised travel and lowered drive positions with respect to said swing arm distal ends;
(9) a pair of track subassemblies each mounted on a respective track jack subassembly and including an endless track and a hydraulic motor; and
(10) said track subassembly hydraulic motors being selectively connected to said hydraulic pump; and (c) an application system including:
(1) an air compressor mounted on said platform and drivingly connected to said engine;
(2) a drumhead subassembly adapted for mounting on a material container and including pneumatic stirring means adapted to stir said container contents, said pneumatic stirring means being connected to said air compressor;
(3) said drumhead subassembly including a suction line adapted to extend into said material container;
(4) a preservative pump communicating with said suction line and said air compressor;
(5) a mounting subassembly mounting said application system on said chassis in one of said access openings and including pivotal parallelogram linkage whereby said application system is movable between lowermost and uppermost positions;
(6) a sprayer subassembly including a discharge valve communicating with a spray head having a nozzle;
(7) a supply line communicating said preservative pump with said sprayer subassembly;
(8) an actuating subassembly including an electrical power source, a solenoid-actuated air valve connected to said air compressor and an electrical actuating switch connected to said solenoid valve and to said electrical power source, said actuating switch having a trigger adapted to selectively engage a railroad tie whereby said trigger is moved between a first position with said switch open and a second position with said switch closed;
(9) said actuating subassembly including a pneumatic piston-and-cylinder unit connected to said solenoid valve; and
(10) an actuating lever connected to said discharge valve and movable between a first position with said discharge valve open and a second position with said discharge valve closed, said actuating lever being connected to said pneumatic piston-and-cylinder unit.

31. A vehicle for applying preservative to the railroad ties of a railroad track including a rail, which comprises:

(a) a chassis system adapted to receive a container of the preservative;
(b) a drive system mounted on said chassis system and adapted to drive said vehicle along the railroad track; and
(c) an application system associated with said chassis system and including:
(1) dispenser means adapted to dispense said preservative onto the railroad ties;
(2) actuating means adapted to selectively actuate said dispenser means; and
(3) a skid runner subassembly depending from said chassis system and mounting said dispenser means.

32. A vehicle for applying preservative to the railroad ties of a railroad track including a rail, which comprises:

(a) a chassis system adapted to receive a container of the preservative;
(b) front and back ends;
(c) opposite sides; and
(d) a drive system mounted on said chassis system and adapted to drive said vehicle along the railroad track, said drive system including:
(1) a drive track assembly mounted on said chassis;
(2) a swing arm with a proximate end pivotally mounted on one of said vehicle front and back ends and a distal end;

(3) said drive track assembly including a track subassembly mounted on said swing arm distal end; and (4) said drive track assembly being swingable on said swing arm between a first position on one of said vehicle opposite sides and a second position on the other said vehicle side.

33. A method of applying preservative to the railroad ties of a railroad track having at least one rail, which comprises the steps of:

(a) providing a vehicle for transporting a supply of preservative along said railroad track;

(b) providing an application system with dispenser means for selectively dispensing preservative onto the railroad ties;

(c) detecting a first position of said vehicle with respect to a railroad tie whereat said dispenser means is directed at said railroad tie;

(d) automatically discharging an amount of said preservative onto said railroad tie with said vehicle in its first position;

(e) detecting a second position of said vehicle with said dispenser means directed between a pair of railroad ties; and (f) automatically terminating the dispensing of said material in response to said vehicle being in its second position.

34. The method according to claim 33, which includes the additional step of:

(a) removing the rail along one side of the railroad track.

35. The method according to claim 34, which includes the additional steps of:

(a) providing said vehicle with front and back wheels adjacent one side thereof;

(b) engaging said vehicle wheels on said remaining rail;

(c) providing said vehicle with front and back drive track assemblies adjacent front and back ends of said vehicle; and (d) driving said vehicle with said track assemblies on the side of said railroad track from which said rail is removed.

36. The method according to claim 35, which includes the additional steps of:

(a) providing front and back wheels adjacent the other side of said vehicle;

(b) providing jack means for extending and retracting said drive track assemblies;

(c) retracting said drive track assemblies when said vehicle crosses a street crossing on said railroad track whereat both rails are in place; and (d) engaging said wheels on said rails at said street crossing.

37. The method according to claim 36, which includes the additional step of:

(a) sequentially retracting and extending said drive assemblies as said vehicle enters and leaves the street crossing.

38. The method according to claim 33, which includes the additional step of:

(a) discharging said preservative with a pump.

39. The method according to claim 35, which includes the additional steps of:

(a) providing a switch on said vehicle;

(b) closing said switch upon engagement with a railroad tie;

(c) creating an electrical railroad tie detection signal; and (d) discharging said preservative in response to said railroad tie detection signal.

40. The method according to claim 39, which includes the additional step of:

(a) pneumatically relaying said railroad tie detection signal to initiate said material discharge.

41. A method of applying preservative to railroad ties in a railroad track including a pair of parallel rails each connected to a plurality of transversely-extending railroad ties at connection areas adjacent to the railroad tie ends, which comprises the steps of:

(a) removing the rail along one side of the railroad track whereby the connection areas along said one side are exposed;

(b) providing a vehicle with a quantity of preservative, front and back pairs of wheels and a pair of extendable and retractable drive track assemblies;

(c) engaging the wheels on one side of said vehicle with said remaining railroad track;

(d) extending the drive track assemblies on the other side of the vehicle;

(e) driving said vehicle along said railroad track with said drive track assemblies;

(f) providing said vehicle with an actuating subassembly;

(g) engaging a railroad tie with said actuating subassembly;

(h) opening a discharge valve for said preservative in response to the engagement of said railroad tie with said actuating subassembly;

(i) discharging preservative through said open discharge valve;

(j) disengaging said actuating subassembly from said railroad tie; and (k) closing said discharge valve in response to disengagement of said actuating subassembly from said railroad tie.

* * * * *